United States Patent [19]

Peters

[11] Patent Number: 4,542,848

[45] Date of Patent: Sep. 24, 1985

[54] STRONG BOX

[76] Inventor: Raymond A. Peters, 521 W. 159th St., New York, N.Y. 10032

[21] Appl. No.: 621,231

[22] Filed: Jun. 15, 1984

[51] Int. Cl.[4] ..... E05G 1/00

[52] U.S. Cl. ..... 232/4 R; 109/45; 109/64

[58] Field of Search ..... 232/4 R, 6; 109/45, 109/64

[56] References Cited

U.S. PATENT DOCUMENTS

| | | | |
|---|---|---|---|
| 1,470,360 | 10/1923 | Hafer et al. | 232/4 R |
| 1,476,735 | 12/1923 | Stockel | 232/4 R |
| 3,871,284 | 3/1975 | Krise | 109/64 X |

*Primary Examiner*—Robert P. Swiatek

*Attorney, Agent, or Firm*—Howard M . Schwinger

[57] ABSTRACT

A strong box which is locked by rotating a threaded arm into a thread engaging member within the box, the threading being permitted only when a locking mechanism, from which the threaded arm depends, is released by a key which has access to the locking mechanism from outside the box.

1 Claim, 3 Drawing Figures

STRONG BOX

This invention relates to strong boxes and more particularly to a box-lock combination which may be advantageously used as a mail box.

Mail boxes presently found in the lobbies of urban multiple dwellings are prone to burglary because the locks presently employed in the boxes are not reliable. The locks can readily be picked or the doors of the boxes readily forced open.

It is thus an important object of the present invention to provide a box and lock combination which will render the box practically tamper proof and thereby secure its contents from thieves.

Figure 1:
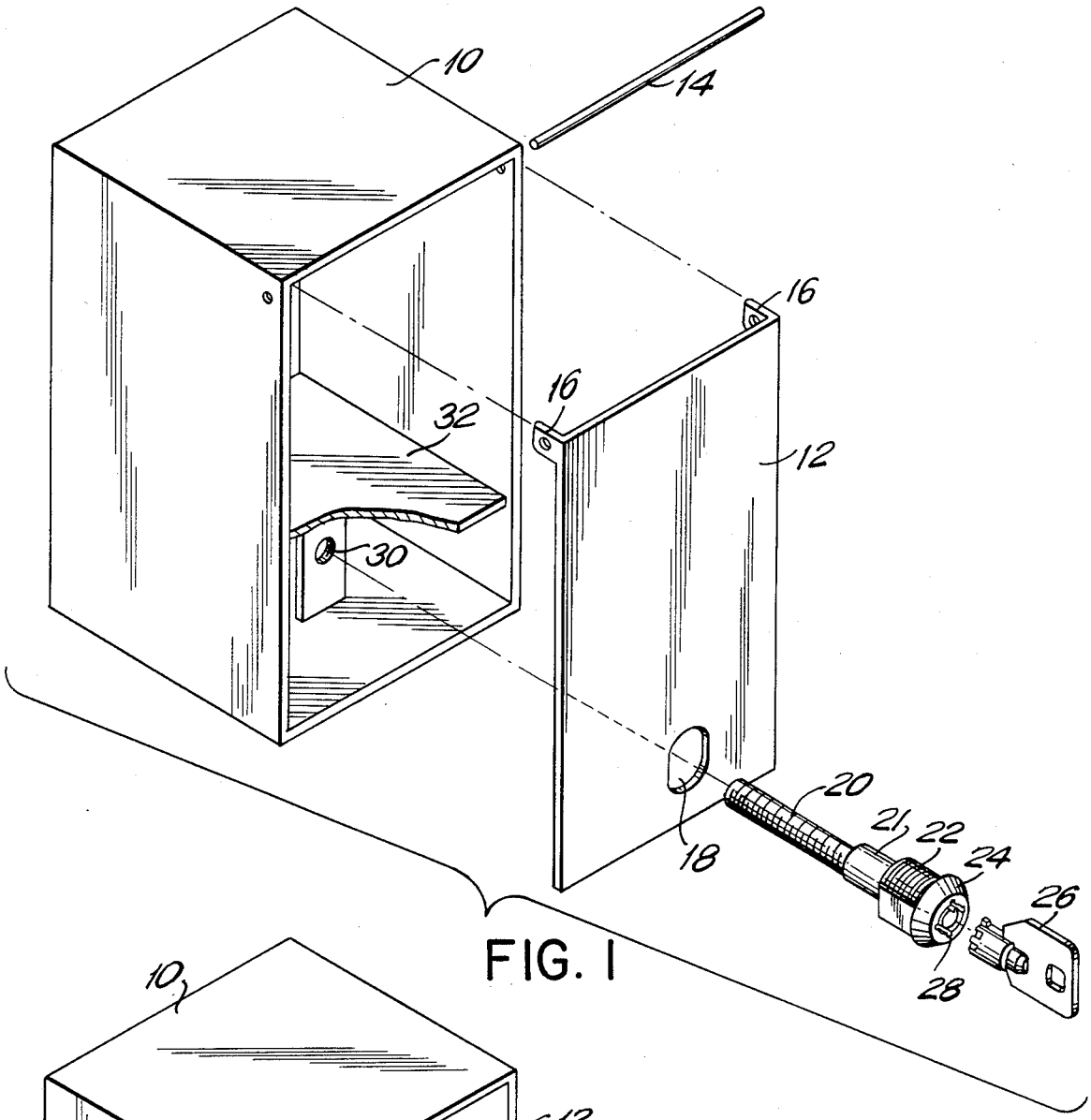
Figure 2:
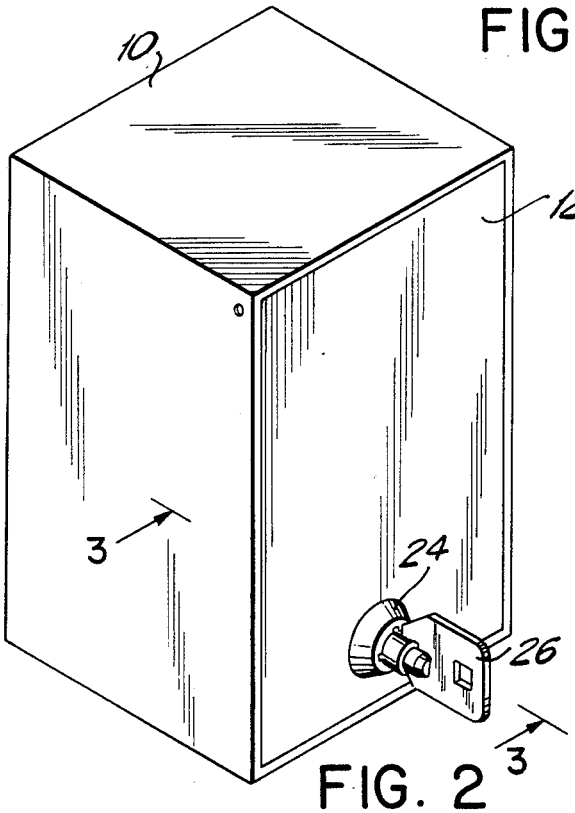
Figure 3:
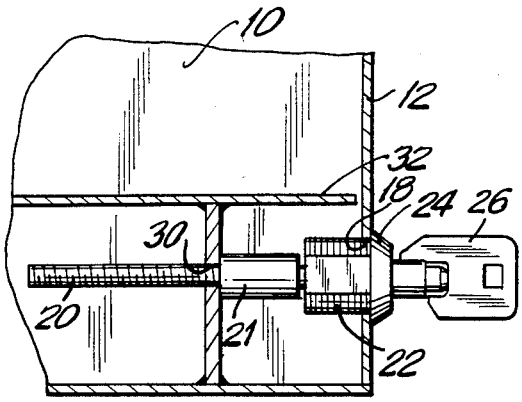

Other objects and advantages of the present invention will become apparant from a reading of the following specification and drawing wherein:

FIG. 1 is an exploded perspective view of a box in accordance with the present invention, FIG. 2 is a perspective view of the box of FIG. 1, when closed, and FIG. 3 is a sectional view taken on line 3—3 of FIG. 2, in the direction of the arrows.

Referring to the drawing, an embodiment of a strong box in accordance with the present invention is shown in FIG. 1 consisting of box 10 which may be closed off by door 12. In this particular embodiment of the invention the door is hung on rod 14 which extends into apertures formed in the side walls of the box for support. The door is provided with apertured brackets 16 so it may be pivotally hung on rod 14.

An opening 18 is provided on the lower end of the door for a locking device which consists of an elongated threaded member 20, spacer 21, locking mechanism 22 and a key engaging head 24. The threaded member, spacer and locking mechanism are dimensioned to pass through opening 18 and be maintained interiorly of the box whereas the key engaging head is outwardly flanged to as to extend over opening 18 on the outside of the door.

In reality, if the box is to be used as a mail box in a multiple dwelling, it will be recessed into the wall with only its door exposed, there being a whole series of such boxes grouped together as a postal unit. Access by the mailman is not treated by this invention, that being handled in a completely different fashion. This invention treats access into the box by the box owner.

Threaded member 20 may be rotated when a suitable key such as 26 is inserted into the groove 28 of key engaging head 24. When sufficient pressure is brought to bear upon locking mechanism 22 by key 26 it is possible to rotate the threaded member by rotating the key, the pressure compressing a spring (not shown) and permitting the proximal end of the threaded member to clear obstacles to its rotation within the locking mechanism.

Engaging means 30 having an aperture are provided within the box to receive threaded member 20. Such thread engaging means may, of course, take a variety of forms. In this instance it consists of a plate 30 having an opening for member 20. Member 20 may be screwed into the aperture of means 30 until the door 12 is firmly clamped against box 10. In this instance the door is clamped against the front edge of the false bottom 32. Inasmuch as head 24 is immovable, the door can only be opened with a suitable key. The box is provided with a false bottom 32 so member 30 will not present an obstacle to handling.

Having thus described the invention it will be understood that variations may be made therein without departing from the spirit and the letter of what is claimed herein.

I claim:

1. A strong box comprising a compartment having an outwardly opening door, said door, when closed, striking the edge of a wall dividing the interior of the box into upper and lower compartments, the wall preventing the door from penetrating the box, said door having an opening for an elongated locking device which includes an assemblage comprising a key receiving head, a locking mechanism and an elongated threaded arm, said assemblage being one piece, the threaded arm and locking mechanism dimensioned to penetrate the box through the opening, said assemblage being housed in the lower compartment, the head being flanged to abut the door when the remainder of the locking device is inserted through the opening, the head and locking mechanism being non-rotatably mounted on the door, the threaded arm being rotatable when the locking mechanism is depressed by a suitable key, means within the box for threadedly engaging the threaded arm of the locking mechanism so that when the threaded arm is rotated therein in one direction the door is clamped against the abutment, and when the threaded arm is rotated in an opposite direction the threaded arm will be completely withdrawn from the engaging means to free the door, the key receiving head, locking mechanism and threaded arm being separable as a unit from the remainder of the box.

* * * * *